US009625164B2

(12) United States Patent
Vargas et al.

(10) Patent No.: US 9,625,164 B2
(45) Date of Patent: Apr. 18, 2017

(54) VALVE PACKAGE

(71) Applicant: Air System Components, Inc., Plano, TX (US)

(72) Inventors: Luis Leonardo Vargas, Richardson, TX (US); Justin E. Anderson, Richardson, TX (US); Wah Gwain Jeung, Richardson, TX (US)

(73) Assignee: AIR SYSTEM COMPONENTS, INC., Plano, TX (US)

( * ) Notice: Subject to any disclaimer, the term of this patent is extended or adjusted under 35 U.S.C. 154(b) by 773 days.

(21) Appl. No.: 13/829,291

(22) Filed: Mar. 14, 2013

(65) Prior Publication Data

US 2014/0262142 A1 Sep. 18, 2014

(51) Int. Cl.

| | |
|---|---|
| ***F25B 29/00*** | (2006.01) |
| ***F24D 19/00*** | (2006.01) |
| ***F24F 13/32*** | (2006.01) |
| ***F24F 1/00*** | (2011.01) |
| ***F24F 13/02*** | (2006.01) |
| *F24D 3/10* | (2006.01) |
| *F24D 5/00* | (2006.01) |

(52) U.S. Cl.

CPC ..... *F24D 19/00* (2013.01); *F24F 1/0007* (2013.01); *F24F 13/02* (2013.01); *F24F 13/32* (2013.01); *F24D 3/1058* (2013.01); *F24D 5/00* (2013.01); *Y10T 29/49826* (2015.01)

(58) Field of Classification Search

CPC ..... F24D 19/00; Y10T 29/4986; F24F 13/02; F24F 13/32; F24F 1/0007

USPC ..... 165/48.1, 67, 76; 29/428; 248/65

See application file for complete search history.

(56) References Cited

U.S. PATENT DOCUMENTS

| | | | | |
|---|---|---|---|---|
| 6,409,223 | B1 * | 6/2002 | Bartholoma | F16L 3/1226 285/114 |
| 6,443,402 | B1 * | 9/2002 | Ferrill | F16L 3/04 248/65 |
| 6,951,324 | B2 * | 10/2005 | Karamanos | F24D 19/02 248/300 |
| 7,621,486 | B1 * | 11/2009 | Barrepski | F16L 3/127 248/228.7 |
| 8,146,377 | B2 * | 4/2012 | Karamanos | F24F 1/26 62/259.1 |
| 2003/0085022 | A1 * | 5/2003 | Viso | F24F 13/30 165/67 |
| 2003/0085023 | A1 * | 5/2003 | Viso | F24F 13/30 165/67 |

(Continued)

*Primary Examiner* — Len Tran
*Assistant Examiner* — Claire Rojohn, III
(74) *Attorney, Agent, or Firm* — Jackson Walker LLP; Christopher J. Rouk

(57) ABSTRACT

A heating, ventilating and air conditioning (HVAC) assembly that includes a duct and a coil assembly coupled to the duct. A supply line and return line are connected to the coil assembly. A first hanger assembly encircles the supply line, and a second hanger assembly encircles the return line. A support bracket has a first raised channel with a hole and second raised channel with a hole. A first threaded connector is secured using a square nut located in under the raised channel of the bracket, and a second threaded connector is connected to the threaded hole of the second hanger assembly and the second hole in a raised channel of a bracket and secured using a square nut located in under the raised channel of the bracket.

10 Claims, 3 Drawing Sheets

(56) References Cited

U.S. PATENT DOCUMENTS

| | | | | |
|---|---|---|---|---|
| 2003/0222185 | A1* | 12/2003 | Rubenstein | H02G 3/30 248/68.1 |
| 2006/0040769 | A1* | 2/2006 | McNulty | A63B 69/0071 473/431 |
| 2006/0249589 | A1* | 11/2006 | Karamanos | F24F 1/26 236/49.3 |
| 2007/0262162 | A1* | 11/2007 | Karamanos | F24F 13/1413 236/49.3 |
| 2008/0164006 | A1* | 7/2008 | Karamanos | F24F 1/0059 165/67 |
| 2010/0319839 | A1* | 12/2010 | Shumate | B32B 7/12 156/165 |
| 2011/0204195 | A1* | 8/2011 | Stanley | E04D 13/1407 248/224.8 |
| 2011/0240207 | A1* | 10/2011 | Stanley | E04D 13/1407 156/91 |
| 2014/0049145 | A1* | 2/2014 | Mathuria | F24F 13/222 312/229 |
| 2014/0167405 | A1* | 6/2014 | Lahey | F24F 13/32 285/64 |

* cited by examiner

VALVE PACKAGE

TECHNICAL FIELD

The present disclosure relates to heating and cooling equipment, and more specifically to a valve package for heating and cooling equipment that prevents attached supply and return lines from being damaged during shipping.

BACKGROUND OF THE INVENTION

Heating and cooling equipment is typically assembled in the field from basic components such as ductwork and conduits, because assemblies can be easily damaged during shipping. As such, the cost savings that might be realized from pre-assembling such equipment is offset by the additional cost that is needed to repair assemblies that are damaged during shipment.

SUMMARY OF THE INVENTION

A heating, ventilating and air conditioning (HVAC) fan powered or non-fan powered assembly that includes a duct and a coil assembly coupled to the duct is provided. A supply line and return line are connected to the coil assembly, such as to provide heated or chilled water. The HVAC assembly could have either one set or two sets of supply and return lines. A first hanger assembly that includes a hinged frame, a hinge, a screw, a threaded hole, and a support hole encircles the supply line, and a second hanger assembly that includes a hinged frame, a hinge, a screw, a threaded hole, and a support hole encircles the return line. A support bracket is connected to the duct and has a first raised channel with a hole and second raised channel with a hole. A first threaded connector is connected to the threaded hole of the first hanger assembly and the first hole in the raised channel of the support bracket and threaded into a square nut located under support bracket channel between the support bracket and duct. A second threaded connector is connected to the threaded hole of the second hanger assembly and the second hole in the raised channel of the support bracket and threaded into a square nut located under support bracket channel between the support bracket and duct.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views, and in which.

DETAILED DESCRIPTION OF THE INVENTION

Figure 1:
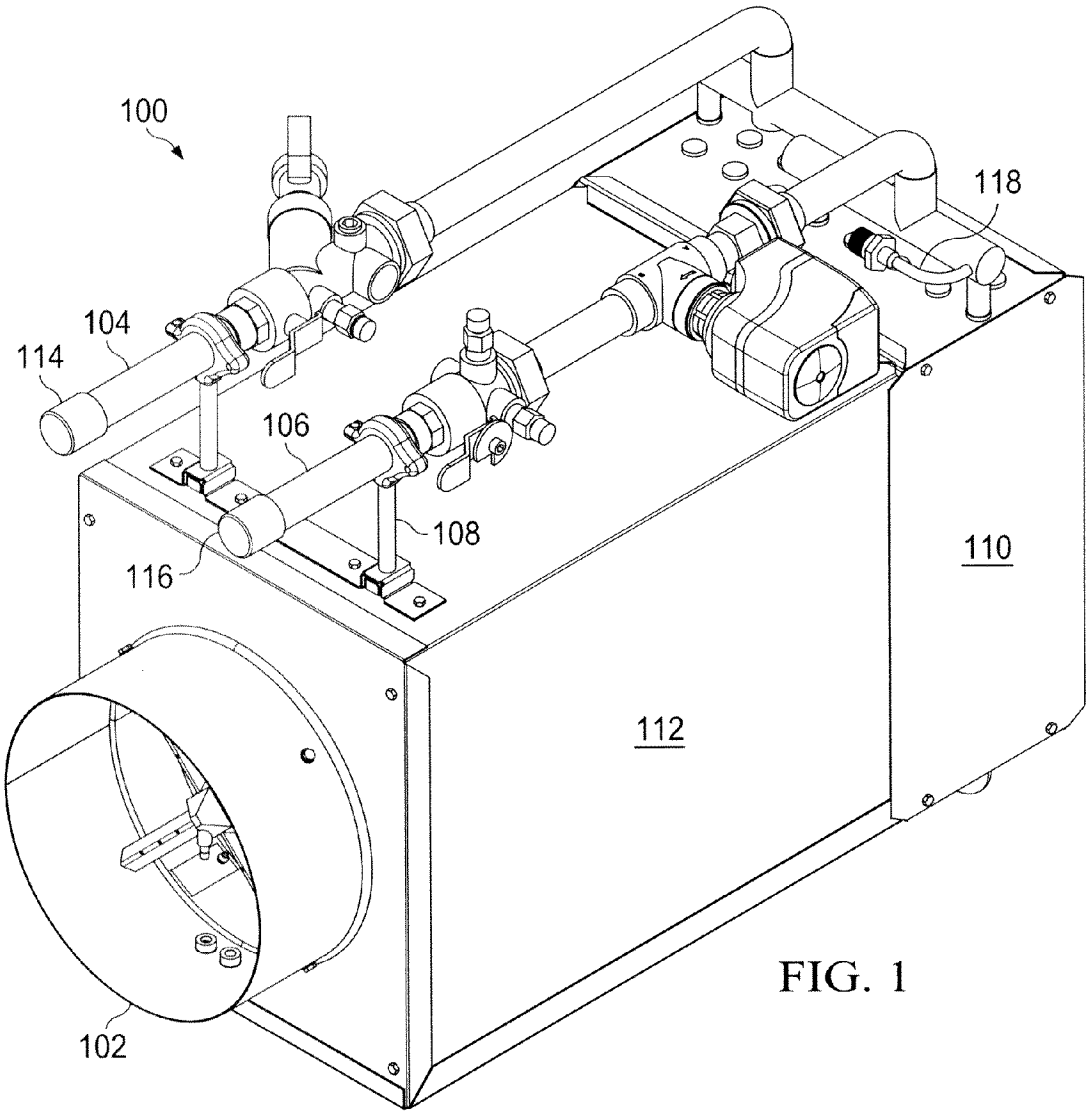
FIG. 1 is a diagram of a heating, ventilating and air conditioning (HVAC) assembly with a valve package in accordance with an exemplary embodiment of the present disclosure.

In the description that follows, like parts are marked throughout the specification and drawings with the same reference numerals. The drawing figures might not be to scale and certain components can be shown in generalized or schematic form and identified by commercial designations in the interest of clarity and conciseness.

FIG. 1 is a diagram of a heating, ventilating and air conditioning non-fan powered (HVAC) assembly 100 with a valve package in accordance with an exemplary embodiment of the present disclosure. HVAC assembly 100 includes an inlet assembly 102, which is installed in duct 112. Duct 112 is coupled to coil housing 110, which can contain a suitable arrangement of tubing coils to allow a heat exchange medium to be supplied to air flowing through duct 112, as supplied by inlet assembly 102.

HVAC assembly 100 includes manual and automated valve assemblies that are fed by supply line 104 and return line 106, which can be suitable metal or non-metallic conduits that carry a suitable heat exchange medium, such as water. Supply line end 114 and return line end 116 are expanded and sealed, which simplifies forming a connection to the heated or chilled water supply and return pipes by eliminating the need for a coupling and by reducing the number of joints that require brazing. In addition, supply line end 114 and return line end 116 allows HVAC assembly to be shipped with a positive or negative pressure inside of the sealed pipes, and Schrader valve 118 can be used to determine whether the positive or negative pressure has been maintained during shipping, so as to be able to detect whether any leaks or other damage might be present.

The heat exchange medium is provided to coil housing 110 by supply line 104, circulates through the coils contained within coil housing 110 where it heats or cools air from duct 112 and inlet assembly 102, and returns through return line 106, where it can be heated or cooled, respectively. In this manner, a heated heat exchange medium can be used to heat air from duct 112 (in which case the heat exchange medium is cooled) and a chilled heat exchange medium can be used to cool air from duct 112 (in which case the heat exchange medium is heated). In addition, although a single set of supply lines is shown, two sets of supply lines can be used, such as where one set is used for heating and a second set is used for cooling. In this exemplary embodiment, two sets of coils can also be provided, or suitable valve connections can be used to switch between the heating supply lines and the cooling supply lines, but in any configuration, support 108 can be used to prevent the supply lines from being damaged during shipment.

In order to allow supply line 104, return line 106 and the associated valves and actuators to be pre-installed onto coil housing 110 and the associated coils, it is necessary to provide support to supply line 104 and return line 106 in a manner that facilitates shipping while preventing shipping-related damage. Prior solutions have utilized a handle structure that also functions as a support for the associated duct, but such handle structures can contribute to shipping-related damage by facilitating use of supply line 104 and return line in a manner for which they were not designed. In order to prevent such use, the present disclosure provides support 108, which can be contained within shrink wrap or other materials that can also cover supply line 104, return line 106 and the associated valves and actuators. In this manner, personnel are not provided with a handle or other means for grasping supply line 104 or return line 106 during shipping or installation, and damage to supply line 104, return line 106, the associated valves or actuators or coils contained within coil housing 110 can be prevented. Support 108 utilizes duct 112 for support, and does not support duct 112, which allows support 108 to be smaller and less expensive than prior solutions that utilize a handle structure that also functions as a support for the associated duct.

Figure 2:
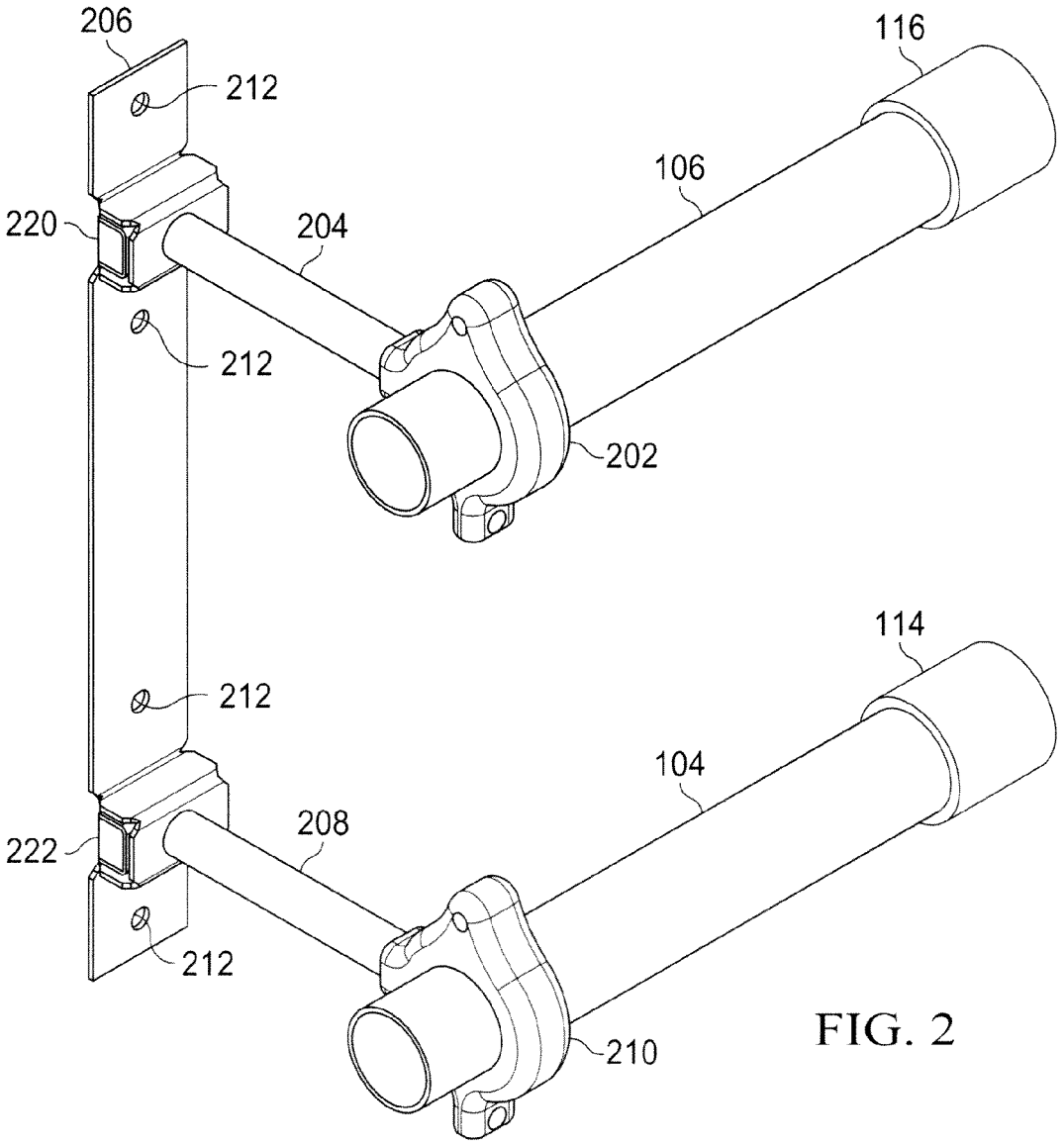
FIG. 2 is a diagram of a support in accordance with an exemplary embodiment of the present disclosure.

FIG. 2 is a diagram of support 108 in accordance with an exemplary embodiment of the present disclosure. Support 108 includes hangers 202 and 210, which can be fabricated from copper or other suitable materials. Hanger 210 encloses supply line 104 and hanger 202 encloses return line 106, so as to provide a firm support for supply line 104 and return line 106 without providing an area that can be readily grasped, so as to prevent misuse or mishandling of support 108 during shipping or installation.

Support 108 includes lateral supports 204 and 208, which are coupled to hangers 202 and 210, respectively. In one exemplary embodiment, lateral supports 204 and 208 can be all-thread connectors, which can be screwed into a threaded hole in each of hangers 202 and 210, respectively, or which can be brazed, welded, riveted or otherwise suitably attached. Lateral supports 204 and 208 are also coupled to support bracket 206, such as by being inserted into holes in a raised channel of support bracket 206 and screwed into squared threaded nuts 220 and 222, respectively, located in the raised channel of support bracket 206 located between support bracket 206 and duct 112, or by being brazed, welded, riveted or otherwise suitably attached to support bracket 206. In one exemplary embodiment, the use of all thread connectors with coordinated threads on hangers 202 and 210 and support bracket 206 can allow the tension between supply line 104, return line 106 and support bracket 206 to be adjusted, so as to provide a firm support for supply line 104 and return line 106 without providing too much lateral force, which can cause supply line 104, return line 106 or the connection of supply line 104 and return line 106 to coil housing 110 or the coils contained within coil housing 110 to be damaged.

Support bracket 206 includes installation holes 212, which allow support bracket 206 to be bolted, riveted or otherwise attached to duct 112 at a suitable location. Likewise, support bracket 206 can be brazed, welded or otherwise suitably connected to duct 112 or other suitable structures.

Figure 3:
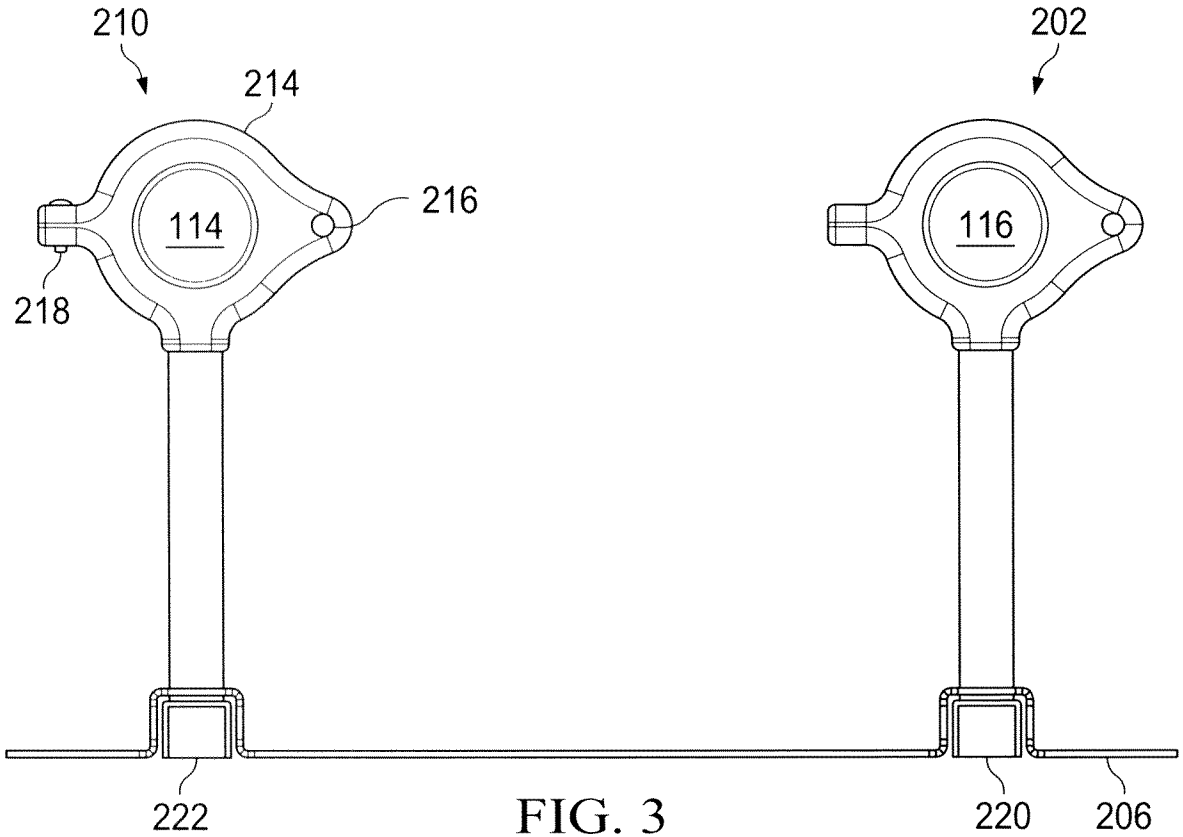
FIG. 3 is a side view showing a support in accordance with an exemplary embodiment of the present disclosure.

FIG. 3 is a side view showing support 108 in accordance with an exemplary embodiment of the present disclosure. In this exemplary embodiment, hangers 202 and 210 can each include a hinged frame 214, having a hinge 216 and associated screw 218. Hangers 202 and 210 can be attached to supply line 104 return line 106 at a suitable location by closing hinged frame 214 around supply line 104 or return line 106, and then by installing screw 218 into hinged frame 214 or otherwise connecting the mating ends of hinged frame 214 opposite hinge 216, such as welding, brazing or with a bolt. In this manner, lateral supports 204 and 208 can be installed in hangers 202 and 210 and support 206 before hangers 202 and 210 are secured to supply line 104 and return line 106, where suitable.

In operation, support 108 allows supply line 104 and return line 106 to be installed on duct 112 and coil housing 110 in a manner that allows supply line 104 and return line 106 to be encased in packaging or otherwise protected from being used to move the assembly that includes duct 112 and coil housing 110, so as to protect supply line 104 and return line 106 from being damaged or from causing damage to duct 112 and coil housing 110 during shipment and installation. Support 108 thus allows complex HVAC assemblies to be manufactured in a single location and shipped to diverse installations without creating an incentive for workers to improperly handle the assembly in a manner that can damage the components of the assembly, which can require subsequent and expensive rework or replacement.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A heating, ventilating and air conditioning (HVAC) assembly, comprising:
- a duct with or without motor/blower assembly;
- a coil assembly coupled to the duct;
- a supply line coupled to the coil assembly;
- a return line coupled to the coil assembly;
- a first hanger assembly encircling the supply line, the first hanger assembly comprising:
  - a hinged frame;
  - a hinge;
  - a screw;
  - a threaded hole; and
  - a conduit support hole;
- a second hanger assembly encircling the return line, the second hanger assembly comprising:
  - a hinged frame;
  - a hinge;
  - a screw;
  - a threaded hole; and
  - a conduit support hole;
- a support bracket coupled to the duct, the support bracket having a first raised channel with hole and second raised channel with hole;
- a first threaded connector coupled to the threaded hole of the first hanger assembly and the first raised channel hole of the support bracket and secured with a square nut; and
- a second threaded connector coupled to the threaded hole of the second hanger assembly and the second raised channel hole of the support bracket and secured with a square nut.

2. The HVAC assembly of claim 1 further comprising a covering to prevent the supply line or the return line from being grasped.

3. A heating, ventilating and air conditioning (HVAC) assembly, comprising: a duct with or without motor/blower assembly; a coil assembly coupled to the duct; a supply line coupled to the coil assembly; a return line coupled to the coil assembly; a first support bracket coupled to the duct and only to the supply line and not to the return line; and a second support bracket coupled to the duct and only to the return line and not to the supply line, the second support bracket configured to provide a low profile so as to prevent grasping of the support bracket by personnel during shipping or installation of the HVAC assembly and a first hanger assembly encircling the supply line, wherein the first hanger assembly further comprises a hinge and a screw opposite the hinge, wherein the first hanger assembly further comprises a support hole, wherein the support bracket further comprises a first threaded hole in a raised channel, further comprising a first threaded connector coupled to the threaded hole of the first hanger assembly and a square nut located under first raised channel with hole of the support bracket, a second hanger assembly encircling the return line, the second hanger assembly comprising: a hinged frame; a hinge; a screw; a threaded hole; and a conduit support hole.

4. The HVAC assembly of claim 3 wherein the support bracket further comprises a first raised channel with hole and second raised channel with hole.

5. The HVAC assembly of claim 3 wherein the first hanger assembly further comprises a hinged frame.

6. The HVAC assembly of claim 3 further comprising a second threaded connector coupled to the threaded hole of the second hanger assembly and a square nut located under second raised channel with hole of the support bracket.

7. A heating, ventilating and air conditioning (HVAC) assembly, comprising: a duct with or without motor/blower assembly; a coil assembly coupled to the duct; a supply line coupled to the coil assembly and supported by a first support bracket and a second support bracket; and a return line coupled to the coil assembly and supported by a third support bracket and a fourth support bracket; wherein the first support bracket and the third support bracket share a first common base and the second support bracket and the fourth support bracket share a second common base wherein the first common base comprises a first raised channel with a hole and second raised channel with a hole, wherein the second common base comprises a first raised channel with a hole and second raised channel with a hole, wherein the first support bracket comprises a first hanger assembly encircling the supply line and coupled to the first raised channel with the hole of the first common base, wherein the second support bracket comprises a second hanger assembly encircling the supply line and coupled to the first raised channel with the hole of the second common base.

8. The HVAC assembly of claim 7 wherein the first support bracket comprises a first hanger assembly encircling the supply line.

9. The HVAC assembly of claim 7 wherein the third support bracket comprises a third hanger assembly encircling the return line and coupled to the second raised channel with the hole of the first common base.

10. The HVAC assembly of claim 9 wherein the fourth support bracket comprises a fourth hanger assembly encircling the return line and coupled to the second raised channel with the hole of the second common base.

* * * * *